US011898747B2

(12) United States Patent
Whyman et al.

(10) Patent No.: US 11,898,747 B2
(45) Date of Patent: Feb. 13, 2024

(54) BURNER SYSTEM AND PROCESS FOR NATURAL GAS PRODUCTION

(71) Applicant: Honeywell International, Morristown, NJ (US)

(72) Inventors: William J. Whyman, Tulsa, OK (US); Kenny Arnold, Tulsa, OK (US)

(73) Assignee: Honeywell International Inc., Charlotte, NC (US)

( * ) Notice: Subject to any disclaimer, the term of this patent is extended or adjusted under 35 U.S.C. 154(b) by 367 days.

(21) Appl. No.: 17/162,309

(22) Filed: Jan. 29, 2021

(65) Prior Publication Data

US 2021/0341141 A1 Nov. 4, 2021

Related U.S. Application Data

(60) Provisional application No. 63/017,989, filed on Apr. 30, 2020.

(51) Int. Cl.
*F23D 11/10* (2006.01)
*F23C 7/00* (2006.01)

(52) U.S. Cl.
CPC ..... *F23D 11/107* (2013.01); *F23C 7/002* (2013.01); *F23D 2204/10* (2013.01)

(58) Field of Classification Search
None
See application file for complete search history.

(56) References Cited

U.S. PATENT DOCUMENTS 2,935,394 A * 5/1960 Hiler ..... B22F 9/305 75/359
3,105,540 A * 10/1963 Hardgrove ..... F23D 17/00 122/7 D
3,857,672 A 12/1974 Reed et al.
4,154,567 A * 5/1979 Dahmen ..... F23G 7/065 431/9
4,237,858 A 12/1980 Goodnight et al.
(Continued)

FOREIGN PATENT DOCUMENTS

CN 102818292 A 12/2012
CN 103244728 A 8/2013
(Continued)

OTHER PUBLICATIONS

International Search Report from corresponding PCT application No. PCT/US2021/028383 dated Aug. 5, 2021.
(Continued)

*Primary Examiner* — Jason Lau

(57) ABSTRACT

A burner apparatus and process are described. The burner apparatus includes an inlet chamber in communication with a combustion chamber. The combustion chamber has a cylindrical shape defining a longitudinal axis and a radial direction orthogonal to the longitudinal axis. The combustion chamber has an upstream end and a downstream end, and an air inlet is disposed in the inlet chamber. A pilot, a fuel gas inlet, and a refractory material are disposed in the combustion chamber downstream of the air inlet. A mixed gas inlet is positioned downstream of the fuel gas inlet and the pilot in the combustion chamber. The mixed gas inlet includes a manifold having an inlet, a body, and a plurality of nozzles.

19 Claims, 7 Drawing Sheets

(56) References Cited

U.S. PATENT DOCUMENTS

| | | | | |
|---|---|---|---|---|
| 4,859,173 | A * | 8/1989 | Davis, Jr. ..... | F23C 7/002 431/9 |
| 2012/0304647 | A1 | 12/2012 | Dudebout et al. | |
| 2013/0244187 | A1 | 9/2013 | Kraus et al. | |

FOREIGN PATENT DOCUMENTS

| | | | |
|---|---|---|---|
| EP | 0003177 | A2 | 7/1979 |
| EP | 0663989 | B1 | 7/1996 |

OTHER PUBLICATIONS

Written Opinion from corresponding PCT application No. PCT/US2021/028383 dated Aug. 5, 2021.

* cited by examiner

BURNER SYSTEM AND PROCESS FOR NATURAL GAS PRODUCTION

CROSS-REFERENCE TO RELATED APPLICATIONS

This application claims the benefit of U.S. Provisional Patent Application Ser. No. 63/017,989 filed on Apr. 30, 2020, the entirety of which is incorporated herein by reference.

BACKGROUND

Waste gas burner systems are used to combust low BTU mixed gas streams produced by various processes in chemical processing facilities. It is important to achieve efficient and stable combustion of low BTU mixed gas streams, while minimizing use of high BTU fuel gases.

Furthermore, current solvent-based acid gas removal technology for natural gas streams treatment has an inherent hydrocarbon loss associated with it, typically about 2-5% or less than 1%. In addition, solvent-based acid gas removal technologies are currently not addressing the disposal of the formed acid gas streams. Increased regulation of gas streams exhausted to the atmosphere can be expected in the future.

Therefore, there is a need for burner systems that can be operated and integrated with existing membrane separation systems. There is also a need for burner systems designed to reduce hydrocarbon loss, reduce the release of harmful gases to the atmosphere, and increase the total treatment block efficiency in terms of utility consumption and losses.

DESCRIPTION OF THE INVENTION

Figure 1:
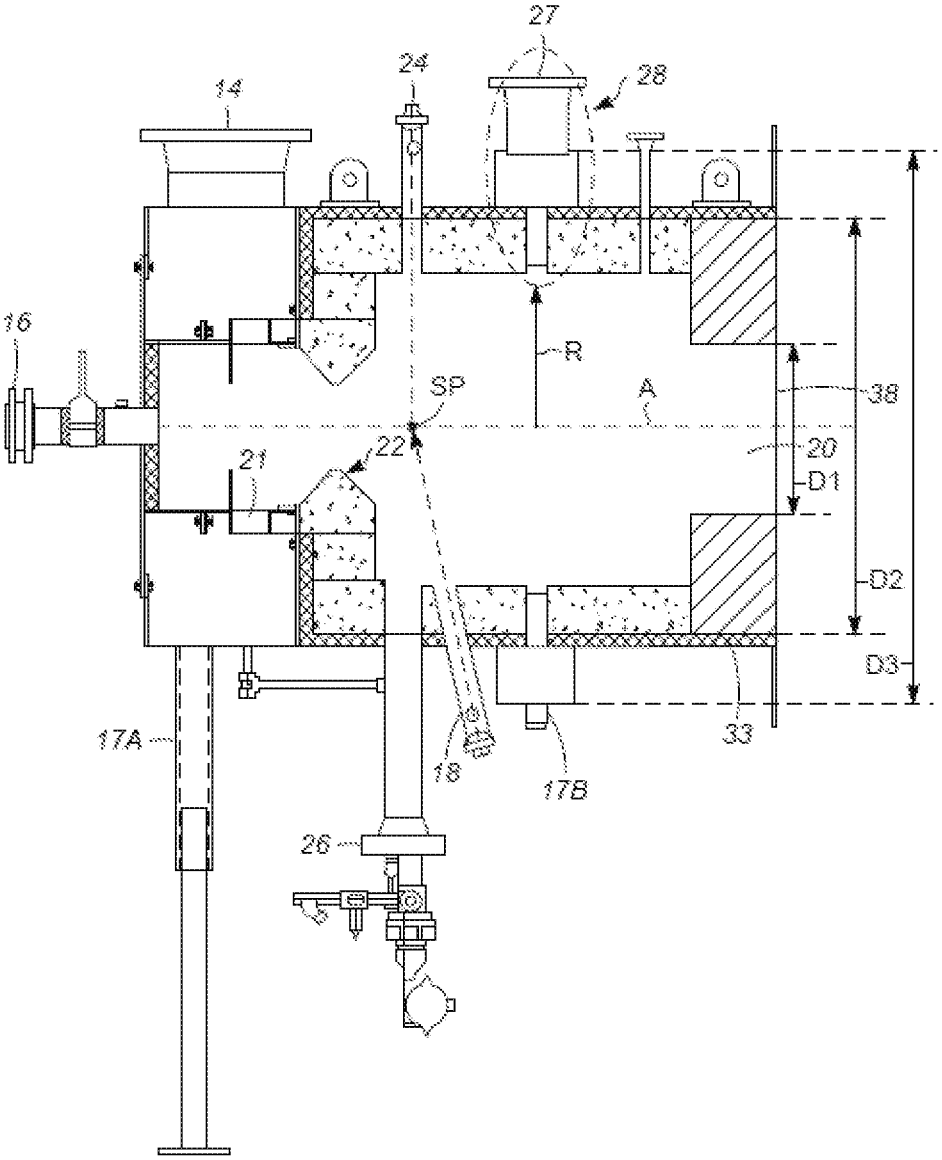
FIG. 1 is a sectional illustration of an embodiment of a burner system.

By combining the membrane separation system and the burner system together, the inherent design of the membrane separation system can be used to modify the waste characteristics going to the burner system. This allows the burner system to operate in a completely different manner, which drastically reduces the fuel usage for the combustion process.

The fuel that is saved is added to the produced gas total to increase the overall gas production. This also reduces the size of the thermal oxidizing or boiler system, and consequently the cost. The weight is also reduced for those systems installed on floating production, storage, and offloading barges (FPSO/Barges).

Current membrane separation systems gather permeate (mixed gas) from multiple locations and combine it into one header for delivery to the thermal oxidizing system for destruction. The thermal oxidizing system requires 20% of the total hydrocarbon content be added as fuel to meet emission requirements for destruction. If the permeate connections are segregated to high hydrocarbon content and low hydrocarbon content, then the thermal oxidizing system can be optimized to reduce fuel usage to virtually none. This results in a size and cost reduction for the thermal oxidizing system. In addition, the reduction in total fuel required results in an increase in produced gas for the total plant.

By integrating the burner system with solvent-based acid gas removal technology (chemical or physical), the lost hydrocarbons can be utilized for thermal destruction of the formed waste streams, thereby reducing OSBL fuel gas requirements. Additionally, the generated heat energy in the combustion section can be partially recuperated via a waste heat recovery boiler, thereby producing either steam or hot oil, which can be used in the reboiler section of some acid gas removal systems, as also in other locations of the acid gas removal system. Producing steam and/or hot oil inside battery limits (ISBL) reduces the dependence of outside battery limits (OSBL) utilities of the acid gas removal system.

One aspect of the invention is an apparatus comprising an inlet chamber in communication with a combustion chamber; the combustion chamber having a round cross section and a longitudinal axis, combustion chamber having a radial direction orthogonal to the longitudinal axis, the combustion chamber having an upstream end and a downstream end; an air inlet disposed in the inlet chamber; a pilot, a fuel gas inlet, and a refractory material disposed in the combustion chamber downstream of the air inlet and the pilot; and a mixed gas inlet positioned downstream of the fuel gas inlet.

Another aspect of the invention is an apparatus for comprising an inlet chamber in communication with a combustion chamber; the combustion chamber having a cylindrical shape having a longitudinal axis and a radial direction orthogonal to the longitudinal axis, the combustion chamber having an upstream end and a downstream end; an air inlet disposed in the inlet chamber; a pilot, a fuel gas inlet, and a refractory material disposed in the combustion chamber downstream of the air inlet and the pilot; and a mixed gas inlet positioned in the combustion chamber, the mixed gas inlet comprising a manifold having an inlet, a body, and a plurality of nozzles.

Another aspect is a process comprising injecting air into an air inlet of a burner apparatus, the burner apparatus having an inlet chamber in communication with a combustion chamber, wherein the air inlet is disposed in the inlet chamber, and a pilot, a fuel gas inlet, and a mixed gas inlet are disposed in the combustion chamber, and wherein the combustion chamber is lined with a refractory material and has a cylindrical shape defining a longitudinal axis and a radial direction orthogonal to the longitudinal axis, the combustion chamber having an upstream end and a downstream end; injecting a mixed gas stream into the mixed gas inlet, the mixed gas inlet disposed downstream of the fuel gas inlet, the mixed gas inlet comprising a manifold having an inlet, a body, and a plurality of nozzles; and combusting air and fuel gas in the combustion chamber.

FIG. 1 illustrates a side sectional elevation view of an embodiment of the burner system 10, which includes a high intensity burner. FIG. 1 is not a true orientation, rather it is a two-dimensional representation of the burner system 10. The upstream end of the burner system 10 includes an inlet (plenum) chamber 12 having an air let 14 disposed on a top nozzle. A scanner 16 disposed on the upstream end and a sight glass 18 provide a views of the sight point SP. In the illustrated embodiment, the sight glass 18 is provided in the combustion chamber 20. In addition, the inlet chamber is provided with a drain 17A.

Figure 3:
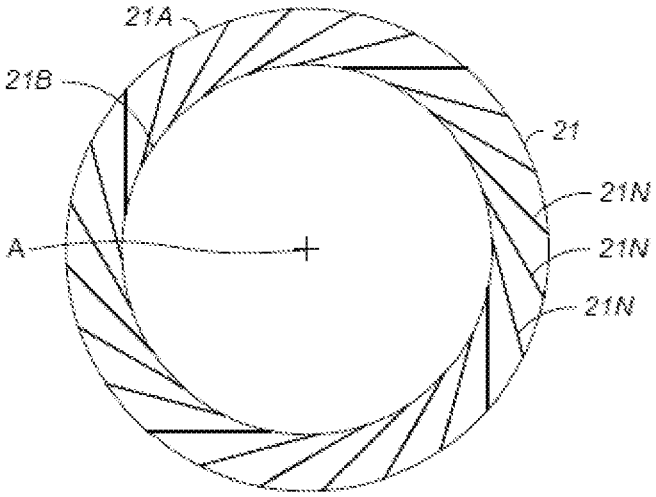
FIG. 3 is a sectional view of the swirl ring of the burner system.

Air coming into the burner system 10 through the air inlet 14 is caused to swirl by a swirl ring 21 mounted in the inlet chamber 12, which is shown in more detail in the sectional view of FIG. 3.

The combustion chamber 20 is disposed downstream of the inlet chamber 12 and has a generally cylindrical cross-section. The length of the combustion chamber 20 defines a longitudinal axis A and the circumference of the combustion chamber 20 defines a radial direction R orthogonal to the longitudinal axis A. The combustion chamber 20 is lined with refractory material 32 and is joined to the inlet chamber 12 by an opening 22.

The mixed gas inlet 27 introduced a mixed gas stream into the combustion chamber and is located downstream of the pilot 26 and the air inlet 14. For example, the mixed gas stream may comprise 13 to 22 mol % methane and other hydrocarbons, 78 to 87 mol % $CO_2$, and trace amounts of $H_2S$, nitrogen and oxygen. In an illustrated embodiment, the mixed gas stream is a first permeate stream of the membrane separation processes shown in FIG. 7 or FIG. 8. Additionally, the mixed gas stream can be a stream comprising relatively high $CO_2$ content of approximately 80 mol % and relatively low hydrocarbon content of approximately 20 mol % methane. The burner system can even maintain a stable flame with a mixed gas stream having 18 mol % methane with no fuel gas required.

Combustion products exit the burner at a downstream outlet 38 (choke), which can be disposed adjacent a thermal oxidizing system or a boiler. The outlet 38 of the combustion chamber has a diameter D1 that is less than the diameter D2 of the combustion chamber and the diameter D3 of the mixed gas manifold 28. The mixed gas manifold 28 extends around the circumference of the combustion chamber 20 and has a drain 17B opposite the mixed gas inlet 27.

Figure 2:
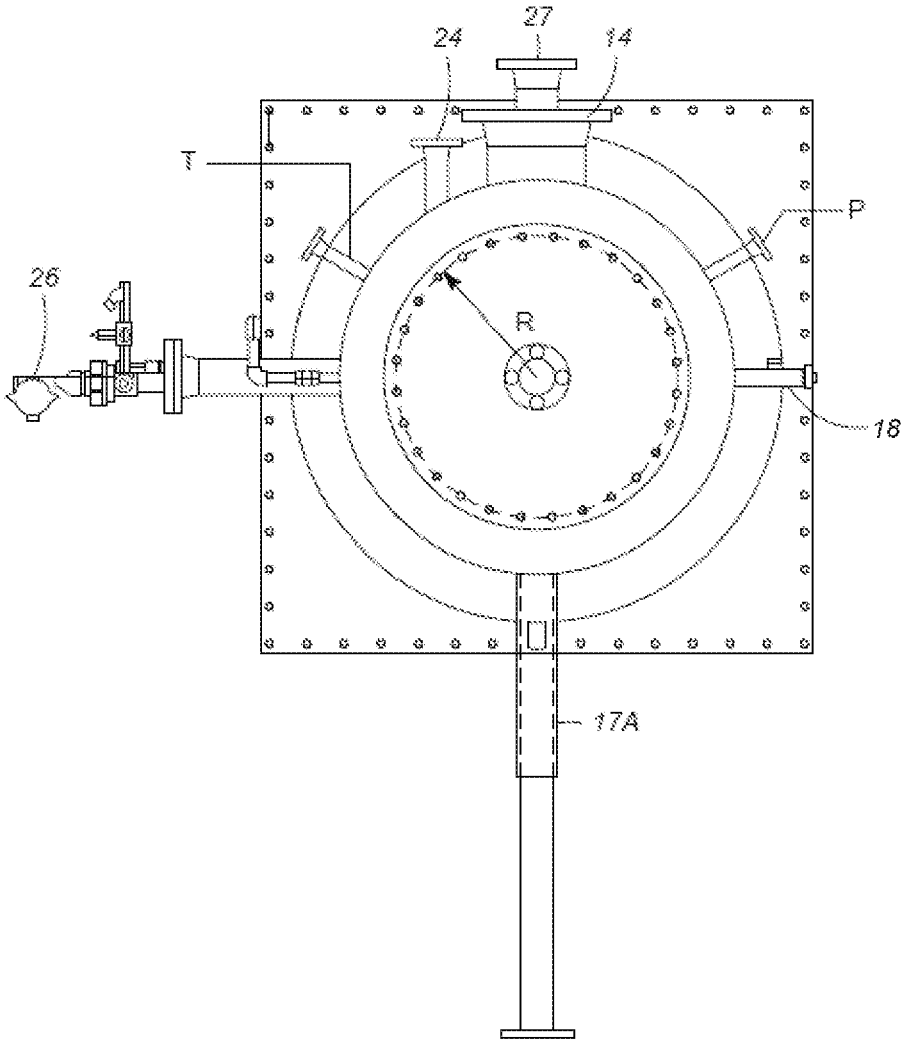
FIG. 2 is a side view of an embodiment of the burner system.

FIG. 2 illustrates a side view of the burner system 10. The air inlet 14 and the mixed gas inlet 27 are mounted at the 12 o'clock position. Optional temperature probes T and sight ports P can be disposed around the circumference of the combustion chamber 20 to monitor the combustion as needed. A scanner 16 is provided in the upstream wall of the inlet chamber 12 and a sight port is provided at the 3 o'clock position in the combustion chamber 20. The fuel gas inlet 24 is provided at an angle relative to the radial direction of the axis of the combustion chamber 20.

FIG. 3 illustrates a detailed sectional view of the swirl ring of the inlet chamber. The swirl ring has an outer diameter 21A, an inner diameter 21B, and a plurality of static vanes 21N than impart a clockwise swirl on the air and combustion reactants, when viewed from the upstream end of the inlet chamber 12 toward the downstream end of the combustion chamber 20.

Figure 4:
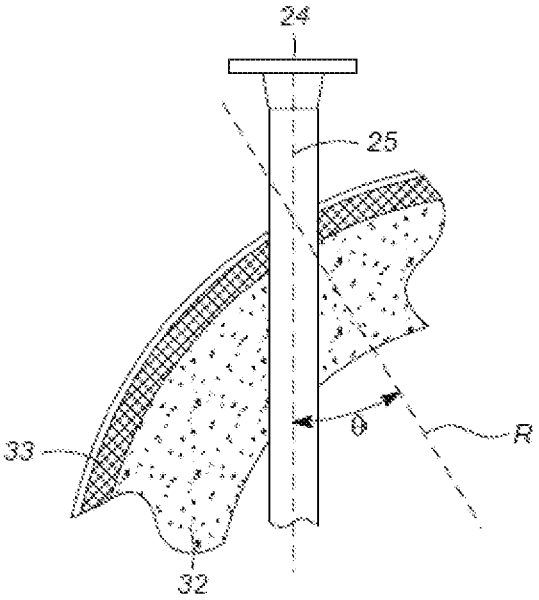
FIG. 4 is a sectional view of the fuel gas inlet of the burner system.
Figure 5:
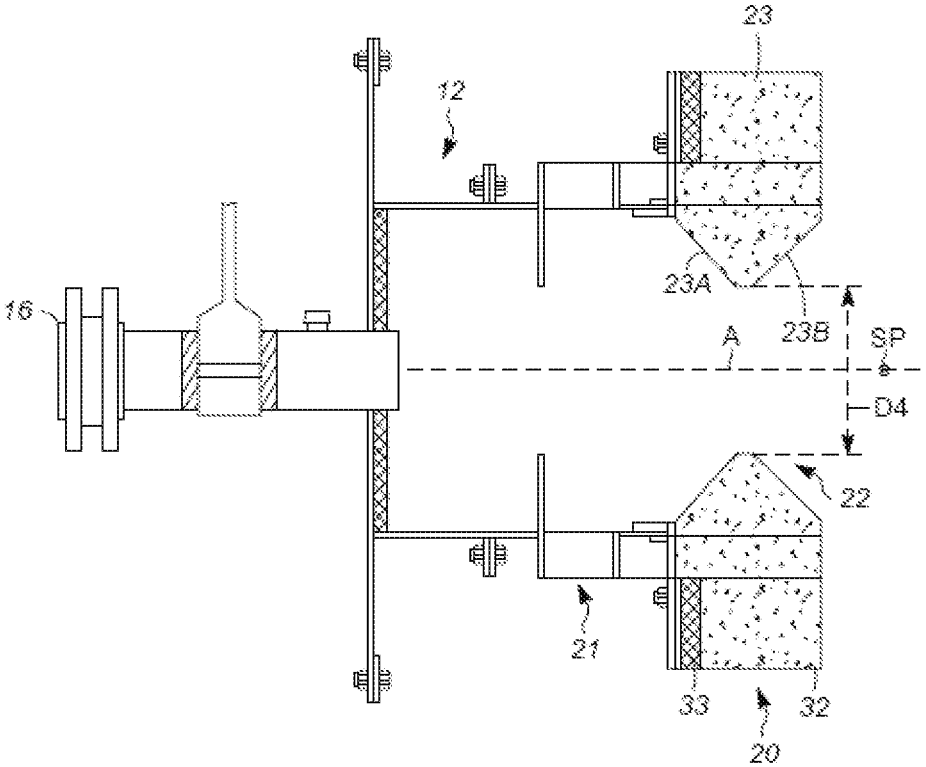
FIG. 5 a sectional view of the inlet chamber of the burner system.

FIG. 4 illustrates a detailed sectional view of the fuel gas inlet 24 which is disposed in the wall of the combustion chamber 20. The wall of the combustion chamber 20 comprises an outer layer 33 of steel and an inner layer of refractory material 32. In the illustrated embodiment, the fuel gas inlet 24 is not aligned with the longitudinal axis A of the combustion chamber 20. Rather, it is disposed at an angle θ of approximately 45 degrees with respect to the longitudinal axis A of the combustion chamber 20. The fuel gas inlet angle θ is defined by the fuel gas inlet nozzle axis 25 relative to the radial direction R, which intersects the longitudinal axis A of the combustion chamber 20. It is contemplated that the fuel gas inlet could be disposed at different angles in different configurations. The fuel gas inlet angle θ could be between about 20 and about 70 degrees FIG. 5 illustrates a detailed sectional view of the inlet chamber 12 of the burner system 10. The scanner 16 can is provided in the upstream end of the inlet chamber 12 in line with the longitudinal axis A to view the sight point SP and, alternatively or in addition, other viewing ports may be provided in line with or at an angle with respect to the longitudinal axis A of the combustion chamber 20. In the illustrated embodiment, the scanner 16 is in line with the sight point SP.

The swirl ring 21 is mounted between the upstream wall of the inlet chamber 12 and the opening 22 of the combustion chamber 20. The opening 22 of the combustion chamber 20 is defined by a hole in the upstream wall 23 of the combustion chamber. The opening comprises an upstream converging portion 23A and a downstream diverging portion 23B. The opening has a diameter D4 that is less than the diameter D2 of the combustion chamber and the diameter of the outlet D1.

Figure 6:
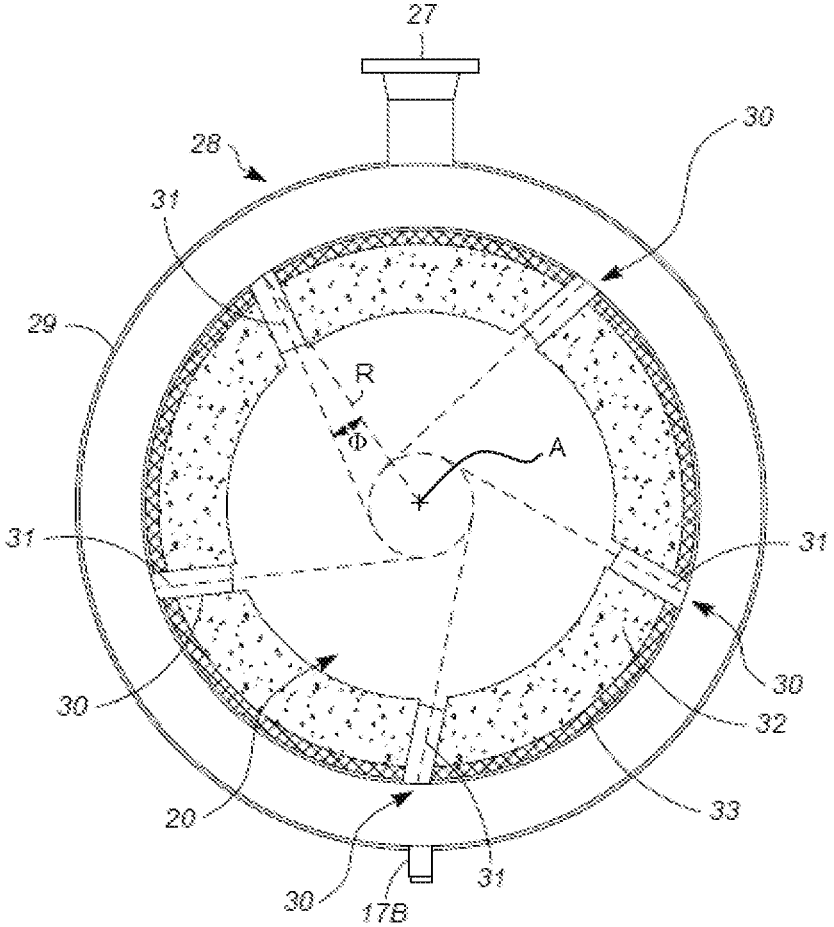
FIG. 6 is a sectional view of the mixed gas inlet manifold of the burner system.

FIG. 6 illustrates a detailed sectional view of the mixed gas inlet manifold. The mixed gas inlet 27 introduces mixed gas to the manifold 28 having a body 29 and a plurality of nozzles 30 disposed on the inner surface of the body 29. The body 29 extends around the circumference of the combustion chamber 20 and the plurality of nozzles extend through the refractory material 32. The nozzles 30 each define a nozzle axis 31 and are disposed at an angle Φ relative to the longitudinal axis A. The nozzle axis angle Φ is defined by the nozzle axis 31 relative to the radial direction R, which intersects the longitudinal axis A of the combustion chamber 20.

In the illustrated embodiment, five nozzles are provided, however it is contemplated that a different number of nozzles could be utilized in different configurations. It is also contemplated that the nozzles could be disposed in a staggered relationship or in rows. A drain 17B is also disposed at the 6 o'clock position opposite the mixed gas inlet 27, which is disposed at the 12 o'clock position.

In the illustrated embodiment, the nozzles are disposed at an angle Φ of approximately 15 degrees, which is defined by the nozzle axis 31 relative to the radial direction R, however it is contemplated that the nozzles could be disposed at different angles in different configurations. The nozzle angle Φ could be between about 5 and about 45 degrees. It is also contemplated to dispose the nozzles at an angle with respect to the radial plane.

The nozzles have diameter that is configured to create a velocity such that the swirl imparted on the flow of combustion reactants by the swirl ring is maintained as the combustion develops and results in a stable combustion. The swirl is optimized to increase the residence time of the mixed gas in the combustion chamber.

Figure 7:
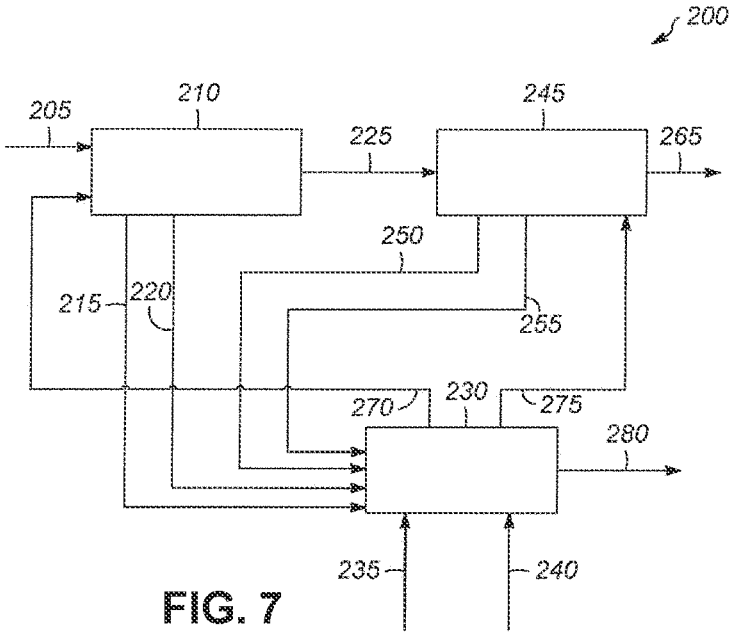
FIG. 7 is an embodiment of a burner system integrated with a membrane separation system and an acid gas removal system.

FIG. 7 illustrates an embodiment of the natural gas purification process 200 of the present invention in which the membrane separation system 210 is combined with a solvent-based acid gas removal system 235. The process shown in FIG. 3 could be used to purify liquefied natural gas (LNG) or for stringent pipeline gas specifications.

A natural gas feed stream 205 is sent to the membrane separation system 210. For example, the natural gas feed stream 305 may comprise 50 to 95 mol % methane and other hydrocarbons, 5 to 50 mol % $CO_2$, and trace amounts of $H_2S$, nitrogen, and oxygen. The membrane separation system 210 may comprise one, two, or more membrane separation units.

The natural gas feed stream 205 is separated into a first permeate gas stream 215, a second permeate gas stream 220, and a purified natural gas stream 225 in the membrane separation system 210. The first permeate gas stream 215 has a higher hydrocarbon content than the second permeate gas stream 220. For example, the first permeate stream 215 may comprise 13 to 22 mol % methane and other hydrocarbons, 78 to 87 mol % $CO_2$, and trace amounts of $H_2S$, nitrogen and oxygen. The second permeate stream 220 may comprise 4 to 8 mol % methane and other hydrocarbons, 92 to 96 mol % $CO_2$, and trace amounts of $H_2S$, nitrogen and oxygen. The purified natural gas stream 325 from the acid gas removal system 310 may comprise 50 to 95 mol % methane and other hydrocarbons, 5 to 50 mol % $CO_2$, and trace amounts of $H_2S$, nitrogen and oxygen.

The first permeate gas stream 215 and the second permeate gas stream 220 are maintained as separate streams and sent to the thermal oxidizing system 230. The thermal oxidizing system 230 includes a combustion chamber with a burner, two (or more) permeate gas inlets, a fuel gas inlet, and a combustion gas inlet. Fuel gas stream 235 and combustion gas stream 240 are fed to the thermal oxidizing system 230. Fuel gas stream 335 may comprise 100 mol % methane and other hydrocarbons. Combustion gas stream 340 may comprise 79 mol % nitrogen and 21 mol % oxygen, for example. The hydrocarbons in the first permeate gas stream 215 are used as a source of fuel for the burner, consequently reducing the amount of external fuel gas required for operating the thermal oxidizing system 230.

In this embodiment, the purified natural gas stream 225 is sent to the solvent-based acid gas removal system 245. The acid gas removal system 245 can be any system that removes acid gas, including but not limited to, chemical solvent-based acid gas removal systems, physical solvent-based acid gas removal systems, or combinations thereof. Suitable chemical solvent-based acid gas removal systems include, but are not limited to, amine treatment, and hot potassium carbonate treatment. For amine treatment, the system would typically include an amine absorber and an amine stripper, along with associated equipment, as is known in the art. See, for example, U.S. Pat. Nos. 8,454,731, 9,334,455. Suitable physical solvent-based acid gas removal systems include, but are not limited to, processes using a solvent comprising a mixture of dimethyl ethers of polyethylene glycol (Selexol is the tradename for this solvent) or a solvent comprising refrigerated methanol (the Rectisol (tradename) process) to remove sulfur compounds and/or $CO_2$ from gas streams. See, for example, U.S. Pat. No. 9,321,004.

In either case, one or more acid gas streams 250, 255 can be fed to the thermal oxidizing system 230. The content of acid gas streams 250, 255 will depend on the acid gas removal system 245 used. For example, flash gas stream 250 may comprise 100 mol % methane and other hydrocarbons, and trace amounts of $CO_2$, $H_2S$, nitrogen, and oxygen. Acid gas $CO_2$ stream 255 may comprise 0.1 to 1 mol % methane and other hydrocarbons, 92 to 96 mol % $CO_2$, 5 to 8 mol % water, and trace amounts of $H_2S$, nitrogen, and oxygen.

The purified natural gas product stream 265 can be recovered. The purified natural gas product stream 265 may comprise 97 to 99.9 mol % methane and other hydrocarbons, 0.1 to 3 mol % $CO_2$, and trace amounts of $H_2S$, nitrogen and oxygen.

The flue gas stream 280 may comprise 0 mol % methane and other hydrocarbons, 30 to 40 mol % $CO_2$, 7 to 11 mol % water, 45 to 55 mol % nitrogen, and 3 mol % oxygen.

In addition, waste heat from the thermal oxidizing system 230 can be used as a source of heat for other parts of the process or other parts of the complex. The hot flue gas can be used directly for heating, or it can be used to make stream or to heat oil. For example, waste heat stream 270 can be used to heat the membrane preheater section of the membrane separation system 210. Alternatively, waste heat stream 275 can be used in the acid gas removal system 245 as a source of heat for column reboilers, for example. The use of the waste heat from the thermal oxidizing system 230 reduces the overall OSBL utility (e.g., steam, and/or hot oil) requirements for the complex.

Although amine absorption technology can achieve almost complete $CO_2$ removal, typically about 1% of the methane gas being treated is lost with the amine plant's $CO_2$ vent gas stream, and another 1-4% is lost if methane is used as fuel for the reboiler of the amine stripper, making the total hydrocarbon loss about 2-5%. By integrating the thermal oxidizing system with the solvent-based acid gas removal system, the fuel for the reboiler is reduced or eliminated. In addition, the 1% loss of methane in the $CO_2$ acid gas can be used as calorific value in the thermal oxidizing system. The integration can be realized with every type of amine guard system, including, but not limited to, flash only, conventional, 1-stage, and 2-stage processes. With the flash only process, the reboiler fuel loss is not applicable.

Furthermore, in some current amine processes, the flash gas is compressed and sometimes treated before being sent to the fuel gas header. In the present process, the flash gas can be sent to the thermal oxidizing system uncompressed and untreated, thus reducing OSBL fuel gas requirements.

The reduced hydrocarbon losses and potential savings from not having to compress the flash gas results in a significant benefit for the overall process.

Figure 8:
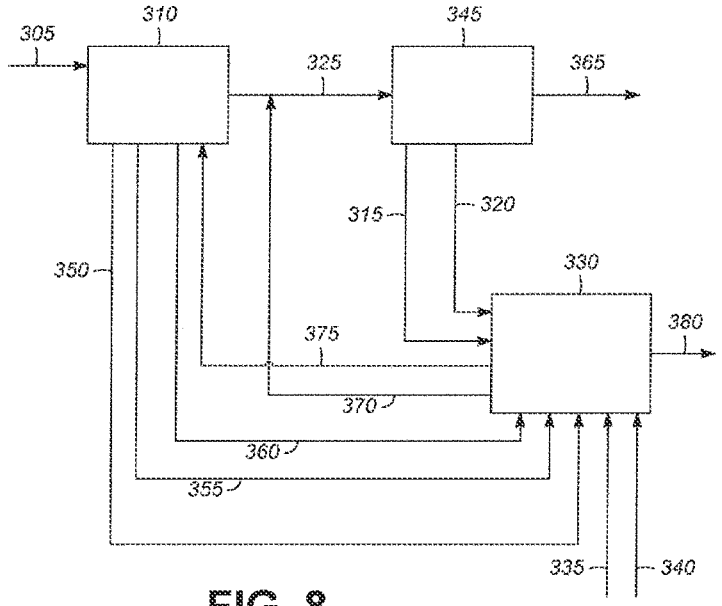
FIG. 8 is another embodiment of a burner system integrated with a membrane separation system and an acid gas removal system.

Alternatively, as shown in FIG. 8, the solvent-based acid gas removal system 310 can be upstream of the membrane separation system 345, rather than downstream. This arrangement could be used to purify natural gas with a high $H_2S$ content. For example, the natural gas feed stream 305 may comprise 50 to 95 mol % methane and other hydrocarbons, 5 to 50 mol % $CO_2$, 1-5 mol % $H_2S$, and trace amounts of nitrogen and oxygen.

The natural gas feed stream 305 is sent to the acid gas removal system 310. Any suitable acid gas removal system 310 can be used, as described above. The content of acid gas streams 350, 355, 360 from the acid gas removal system 310 will depend on the acid gas removal system 310 used. For example, flash gas stream 350 may comprise 100 mol % methane and other hydrocarbons, and trace amounts of $CO_2$, $H_2S$, nitrogen, and oxygen. Acid gas $CO_2$ stream 355 may comprise 0.1 to 1 mol % methane and other hydrocarbons, 92 to 96 mol % $CO_2$, 5 to 8 mol % water, and trace amounts of $H_2S$, nitrogen, and oxygen. Acid gas $H_2S$ stream 360 may comprise 6 to 11 mol % methane and other hydrocarbons, 40 to 50 mol % $CO_2$, 32 to 44 mol % $H_2S$, 2 to 8 mol % water, and trace amounts of nitrogen and oxygen.

One or more of acid gas streams 350, 355, 360 can be fed to the thermal oxidizer system.

The purified natural gas stream 325 from the acid gas removal system 310 may comprise 50 to 95 mol % methane and other hydrocarbons, 5 to 50 mol % $CO_2$, and trace amounts of $H_2S$, nitrogen and oxygen.

The purified natural gas stream 325 is sent to membrane separation system 345. The membrane separation system 325 may comprise one, two, or more membrane separation units.

The purified natural gas stream 325 is separated into a first permeate gas stream 315, a second permeate gas stream 320, and a purified natural gas product stream 365 in the membrane separation system 345. The first permeate gas stream 315 has a higher hydrocarbon content than the second permeate gas stream 320. For example, the first permeate stream 315 may comprise 13 to 22 mol % methane and other hydrocarbons, 78 to 87 mol % $CO_2$, and trace amounts of $H_2S$, nitrogen and oxygen. The second permeate stream 320 may comprise 4 to 8 mol % methane and other hydrocarbons, 92 to 96 mol % $CO_2$, and trace amounts of $H_2S$, nitrogen and oxygen.

The purified natural gas product stream 365 may be recovered. The purified natural gas product stream 365 may comprise 95 to 97 mol % methane and other hydrocarbons, 3 to 5 mol % $CO_2$, and trace amounts of $H_2S$, nitrogen and oxygen.

The first permeate gas stream 315 and the second permeate gas stream 320 are maintained as separate streams and sent to the thermal oxidizing system 330, as described above. Fuel gas stream 335 and combustion gas stream 340 are fed to the thermal oxidizing system 330. Fuel gas stream 335 may comprise 100 mol % methane and other hydrocarbons. Combustion gas stream 340 may comprise 79 mol % nitrogen and 21 mol % oxygen, for example.

The hydrocarbons in the first permeate gas stream 315 are used as a source of fuel for the burner, consequently reducing the amount of external fuel gas required for operating the thermal oxidizing system 330.

The flue gas stream 380 may comprise 0 mol % methane and other hydrocarbons, 30 to 40 mol % $CO_2$, 7 to 11 mol % water, 45 to 55 mol % nitrogen, and 3 mol % oxygen.

As described above, waste heat from the thermal oxidizing system 330 can be used as a source of heat for other parts of the process or other parts of the complex. For example, waste heat stream 370 can be used to heat the membrane preheater section of the membrane separation system 345. Alternatively, waste heat stream 375 can be used in the acid gas removal system 310 as a source of heat for column reboilers, for example.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems 255. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

Specific Embodiments

While the following is described in conjunction with specific embodiments, it will be understood that this description is intended to illustrate and not limit the scope of the preceding description and the appended claims.

A first embodiment of the invention is an apparatus comprising an inlet chamber in communication with a combustion chamber; the combustion chamber having a round cross section and a longitudinal axis, combustion chamber having a radial direction orthogonal to the longitudinal axis, the combustion chamber having an upstream end and a downstream end; an air inlet disposed in the inlet chamber; a pilot, a fuel gas inlet, and a refractory material disposed in the combustion chamber downstream of the air inlet and the pilot; and a mixed gas inlet positioned downstream of the fuel gas inlet. The apparatus of claim 1, wherein the combustion chamber has a diameter, and wherein the inlet chamber and the combustion chamber are joined by an opening defined by an upstream wall of the combustion chamber, wherein the opening is smaller than the diameter of the combustion chamber. An embodiment of the invention is one, any or all of prior embodiments in this paragraph up through the first embodiment in this paragraph, wherein the opening is defined by an upstream converging portion and a downstream diverging portion. An embodiment of the invention is one, any or all of prior embodiments in this paragraph up through the first embodiment in this paragraph, wherein the pilot extends from an outer wall of the combustion chamber toward the longitudinal axis of the combustion chamber. An embodiment of the invention is one, any or all of prior embodiments in this paragraph up through the first embodiment in this paragraph, wherein the fuel gas inlet is disposed at an angle relative to the longitudinal axis of the combustion chamber. An embodiment of the invention is one, any or all of prior embodiments in this paragraph up through the first embodiment in this paragraph, wherein the angle is between about 20 and about 70 degrees. An embodiment of the invention is one, any or all of prior embodiments in this paragraph up through the first embodiment in this paragraph, wherein the mixed gas inlet comprises a manifold having a plurality of nozzles. An embodiment of the invention is one, any or all of prior embodiments in this paragraph up through the first embodiment in this paragraph, wherein the plurality of nozzles is disposed around the circumference of the combustion chamber and are oriented at a further angle relative to the longitudinal axis of the combustion chamber.

A second embodiment of the invention is an apparatus for comprising an inlet chamber in communication with a combustion chamber; the combustion chamber having a cylindrical shape having a longitudinal axis and a radial direction orthogonal to the longitudinal axis, the combustion chamber having an upstream end and a downstream end; an air inlet disposed in the inlet chamber; a pilot, a fuel gas inlet, and a refractory material disposed in the combustion chamber downstream of the air inlet and the pilot; and a mixed gas inlet positioned in the combustion chamber, the mixed gas inlet comprising a manifold having an inlet, a body, and a plurality of nozzles. An embodiment of the invention is one, any or all of prior embodiments in this paragraph up through the second embodiment in this paragraph, wherein each of the plurality of nozzles has a nozzle axis that is disposed at an angle relative to the longitudinal axis of the combustion chamber. An embodiment of the invention is one, any or all of prior embodiments in this paragraph up through the second embodiment in this paragraph, wherein each of the plurality of nozzles is spaced equally around a circumference of the combustion chamber. An embodiment of the invention is one, any or all of prior embodiments in this paragraph up through the second embodiment in this paragraph, the combustion chamber having walls comprising a refractory material, wherein the plurality of nozzles comprise a further material and extend through the refractory material of the combustion chamber. An embodiment of the invention is one, any or all of prior embodiments in this paragraph up through the second embodiment in this paragraph, wherein the body of the manifold extends completely around a circumference of the combustion chamber downstream of the fuel gas inlet. An embodiment of the invention is one, any or all of prior embodiments in this paragraph up through the second embodiment in this paragraph, wherein each of the plurality of nozzles is disposed on an inner surface of the body. An embodiment of the invention is one, any or all of prior embodiments in this paragraph up through the second embodiment in this paragraph, wherein the inlet chamber and the combustion chamber are joined by an opening defined by an upstream wall of the combustion chamber comprising a refractory material. An embodiment of the invention is one, any or all of prior embodiments in this paragraph up through the second embodiment in this paragraph, wherein the opening is formed by an upstream converging portion and a downstream diverging portion of the upstream wall of the combustion chamber. An embodiment of the invention is one, any or all of prior embodiments in this paragraph up through the second embodiment in this paragraph, wherein the fuel gas inlet has a nozzle axis that is disposed at a further angle relative to the longitudinal axis of the combustion chamber. An embodiment of the invention is one, any or all of prior embodiments in this paragraph up through the second embodiment in this paragraph, wherein the angle is between about 5 and about 45 degrees. An embodiment of the invention is one, any or all of prior embodiments in this paragraph up through the second embodiment in this paragraph, wherein the further angle is between about 20 and about 70 degrees.

A third embodiment of the invention is a process comprising injecting air into an air inlet of a burner apparatus, the burner apparatus having an inlet chamber in communication with a combustion chamber, wherein the air inlet is disposed in the inlet chamber, and a pilot, a fuel gas inlet, and a mixed gas inlet are disposed in the combustion chamber, and wherein the combustion chamber is lined with a refractory material and has a cylindrical shape defining a longitudinal axis and a radial direction orthogonal to the longitudinal axis, the combustion chamber having an upstream end and a downstream end; injecting a mixed gas stream into the mixed gas inlet, the mixed gas inlet disposed downstream of the fuel gas inlet, the mixed gas inlet comprising a manifold having an inlet, a body, and a plurality of nozzles; and combusting air and fuel gas in the combustion chamber.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A burner apparatus comprising:

an inlet chamber in communication with a combustion chamber;

the combustion chamber having a round cross section and a longitudinal axis, combustion chamber having a radial direction orthogonal to the longitudinal axis, the combustion chamber having an upstream end and a downstream end;

an air inlet disposed in the inlet chamber;

a pilot, a fuel gas inlet disposed in the wall of the combustion chamber, and a refractory material disposed in the combustion chamber downstream of the air inlet and the pilot; and a mixed gas inlet positioned in the combustion chamber downstream of the fuel gas inlet, the mixed gas inlet comprising a manifold having an inlet and a body, wherein the body of the manifold extends completely around a circumference of the combustion chamber downstream of the fuel gas inlet.

2. The burner apparatus of claim 1, wherein the combustion chamber has a diameter, and wherein the inlet chamber and the combustion chamber are joined by an opening defined by an upstream wall of the combustion chamber, wherein the opening is smaller than the diameter of the combustion chamber.

3. The burner apparatus of claim 2, wherein the opening is defined by an upstream converging portion and a downstream diverging portion.

4. The burner apparatus of claim 2, wherein the pilot extends from an outer wall of the combustion chamber toward the longitudinal axis of the combustion chamber.

5. The burner apparatus of claim 1, wherein the fuel gas inlet is disposed at an angle relative to the longitudinal axis of the combustion chamber.

6. The burner apparatus of claim 5, wherein the angle is between about 20 and about 70 degrees.

7. The burner apparatus of claim 1, wherein the manifold comprises a plurality of nozzles.

8. The burner apparatus of claim 7, wherein the plurality of nozzles is disposed around the circumference of the combustion chamber and are oriented at a further angle relative to the longitudinal axis of the combustion chamber.

9. A burner apparatus for comprising:

an inlet chamber in communication with a combustion chamber;

the combustion chamber having a cylindrical shape having a longitudinal axis and a radial direction orthogonal to the longitudinal axis, the combustion chamber having an upstream end and a downstream end;

an air inlet disposed in the inlet chamber;

a pilot, a fuel gas inlet disposed in the wall of the combustion chamber, and a refractory material disposed in the combustion chamber downstream of the air inlet and the pilot; and a mixed gas inlet positioned in the combustion chamber downstream of the fuel gas inlet, the mixed gas inlet comprising a manifold having an inlet, a body, and a plurality of nozzles, wherein the body of the manifold extends completely around a circumference of the combustion chamber downstream of the fuel gas inlet.

10. The burner apparatus of claim 9, wherein each of the plurality of nozzles has a nozzle axis that is disposed at an angle relative to the longitudinal axis of the combustion chamber.

11. The burner apparatus of claim 9, wherein each of the plurality of nozzles is spaced equally around a circumference of the combustion chamber.

12. The burner apparatus of claim 9, the combustion chamber having walls comprising a refractory material, wherein the plurality of nozzles comprise a further material and extend through the refractory material of the combustion chamber.

13. The burner apparatus of claim 9, wherein each of the plurality of nozzles is disposed on an inner surface of the body.

14. The burner apparatus of claim 9, wherein the inlet chamber and the combustion chamber are joined by an opening defined by an upstream wall of the combustion chamber comprising a refractory material.

15. The burner apparatus of claim 14, wherein the opening is formed by an upstream converging portion and a downstream diverging portion of the upstream wall of the combustion chamber.

16. The burner apparatus of claim 9, wherein the fuel gas inlet has a nozzle axis that is disposed at a further angle relative to the longitudinal axis of the combustion chamber.

17. The burner apparatus of claim 10, wherein the angle is between about 5 and about 45 degrees.

18. The burner apparatus of claim 16, wherein the further angle is between about 20 and about 70 degrees.

19. A burner process comprising:

injecting air into an air inlet of a burner apparatus, the burner apparatus having an inlet chamber in communication with a combustion chamber, wherein the air inlet is disposed in the inlet chamber, and a pilot, a fuel gas inlet disposed in the wall of the combustion chamber, and a mixed gas inlet are disposed in the combustion chamber downstream of the fuel gas inlet, and wherein the combustion chamber is lined with a refractory material and has a cylindrical shape defining a longitudinal axis and a radial direction orthogonal to the longitudinal axis, the combustion chamber having an upstream end and a downstream end;

injecting a mixed gas stream into the mixed gas inlet, the mixed gas inlet disposed downstream of the fuel gas inlet, the mixed gas inlet comprising a manifold having an inlet, a body, and a plurality of nozzles, wherein the body of the manifold extends completely around a circumference of the combustion chamber downstream of the fuel gas inlet; and combusting air and fuel gas in the combustion chamber.

* * * * *